United States Patent [19]

Bloom

[11] 4,366,630

[45] Jan. 4, 1983

[54] FOOT WEAR

[75] Inventor: Leslie I. Bloom, Johannesburg, South Africa

[73] Assignee: AECI Limited, Johannesburg, South Africa

[21] Appl. No.: 211,941

[22] Filed: Dec. 1, 1980

[30] Foreign Application Priority Data

Dec. 7, 1979 [ZA] South Africa ..... 79/6644

[51] Int. Cl.[3] ..... A43B 13/12; A61N 1/14

[52] U.S. Cl. ..... 36/30 R; 36/1; 36/44; 12/146 BR; 361/224

[58] Field of Search ..... 36/44, 1, 30 R, 30 A, 36/32 R; 361/223, 224; 264/244; 12/146 B, 146 BR

[56] References Cited

U.S. PATENT DOCUMENTS

| | | | |
|---|---|---|---|
| 2,279,094 | 4/1942 | Siers | 361/224 |
| 2,407,189 | 9/1946 | Taber, Jr. et al. | 361/224 |
| 2,710,366 | 6/1955 | Stern, Jr. et al. | 36/1 X |
| 3,510,968 | 5/1970 | Hobbs, Jr. et al. | 36/30 A |
| 4,245,406 | 1/1981 | Landay et al. | 36/30 R |

FOREIGN PATENT DOCUMENTS

| | | | |
|---|---|---|---|
| 2147904 | 3/1973 | Fed. Rep. of Germany | 36/32 R |
| 220457 | 5/1968 | Sweden | 361/224 |

*Primary Examiner*—James Kee Chi

*Attorney, Agent, or Firm*—Cushman, Darby & Cushman

[57] ABSTRACT

The invention concerns a composite sole for use in safety footwear, as well as a combination heel and sole and a complete article of footwear, the composite sole comprising an inner sole of electrically conducting material, and a thin flexible outer sole up to about 8 mm thick of electrically conducting material, said outer sole being spaced from the inner sole and connected thereto at a plurality of positions in an electrically conducting manner. Electrically conducting plastics spacer plugs can be used as the connection between the inner and outer soles.

10 Claims, 2 Drawing Figures

FOOT WEAR

Figure 1:
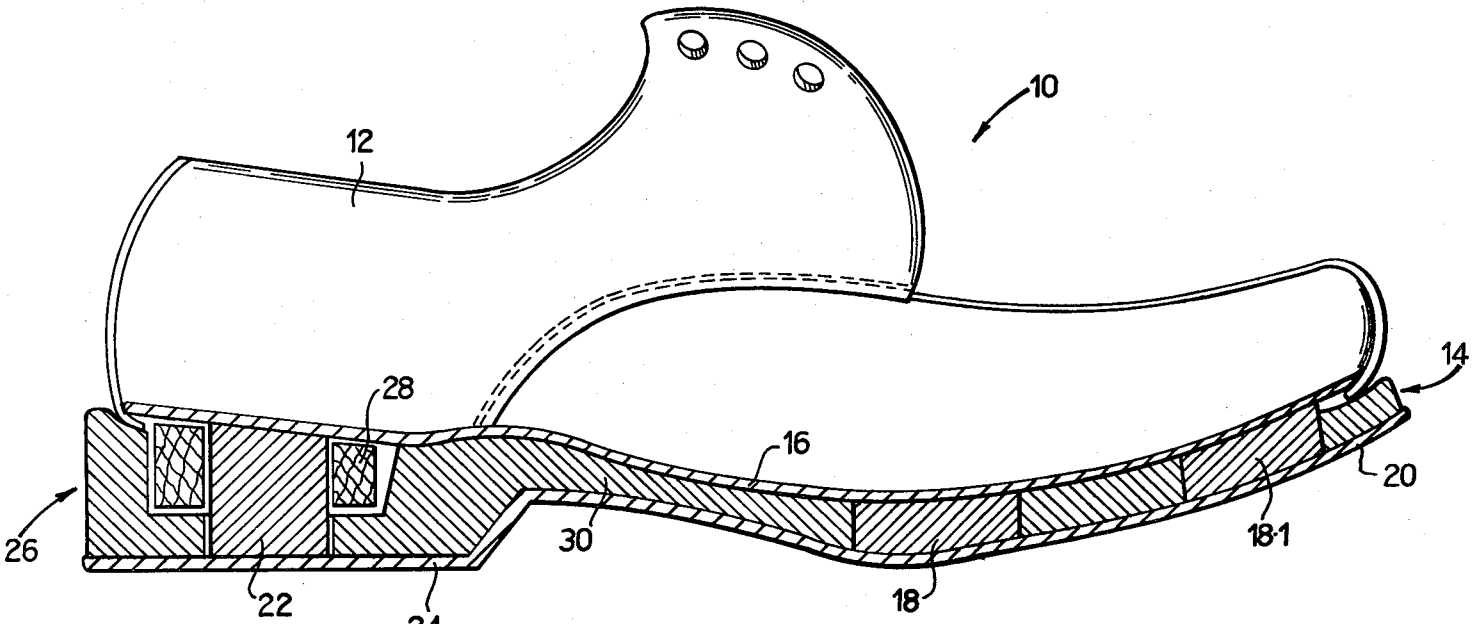

This invention relates to footwear and to sole for use with footwear.

When footwear, such as boots, shoes, or the like, is to be used in an area where there is danger of explosion, e.g. when handling explosives or when handling flammable materials such as fuels, it is desirable to provide footwear which is electrically conductive. According to British Standard 5451, conducting footwear should have a maximum resistance of $1.5\times10^5$ ohm, whereas for anti-static footwear, a resistance in the range $5\times10^4$ to $5\times10^7$ ohm is required.

We are aware of electrically conductive footwear comprising a thick hard-wearing sole of rubber or a plastics material containing carbon as the electrically conducting substance. Such footwear suffers from the disadvantages that the sole becomes very stiff and can crack easily on flexing it, and that the conductivity depends on contact between individual carbon particles or chains of particles of such footwear, and is also rather uncomfortable to wear. In addition, we are aware of footwear comprising an inner sole of electrically conducting material in contact with a plug of electrically conducting material passing through the footwear sole, which sole comprises non-electrically conducting material of a hard-wearing type. This footwear suffers from the disadvantage that there is only a small area of electrical contact with the ground. There is also the problem that the plug can become dislodged during use.

The present invention provides a composite sole for use in safety footwear, said composite sole comprising an inner sole of electrically conducting material, a thin flexible outer sole up to about 8 mm thick of electrically conducting material, said outer sole being spaced from the inner sole and connected thereto at a plurality of positions in electrically conducting manner.

The invention further provides a sole for an article of footwear, said sole comprising the composite sole according to the invention, and as specified above, with a wear-resistant layer provided between the inner and outer soles.

The invention further provides a combined sole and heel for footwear, said sole and heel comprising a composite sole as described above in accordance with the invention, and integrally attached to a heel. One or more layers resistant to flex-cracking and/or of wear-resistant material conveniently are provided between the inner sole on the one hand, and the outer sole and bottom of the heel on the other hand. The underside of the heel may also be provided with a thin layer up to 8 mm thick, of flexible electrically conducting material which is in electrical contact with a rearward extension of the inner sole through the heel. The thin flexible electrically conducting layer forming the underside of the heel may be a continuation of the thin flexible layer forming the underside of the sole.

The invention also provides an article of footwear, particularly a boot, shoe, or the like having a composite sole in accordance with the invention.

The inner sole may be of any suitable material which is used for inner soles of safety footwear. It may be of fiberboard, or a plastics material, provided that it is electrically conductive. It conveniently can contain carbon black to make it electrically conductive.

The outer sole is of thin flexible plastics material. As stated above, the thickness can be up to about 8 mm, more conveniently about 2 to 5 mm thick. The outer sole may be of a thermosetting or a thermoplastics material, provided that it is flexible when it is of the thickness given above. Examples of materials which can be used are polyvinylchloride, polyurethanes, thermoplastic rubber, natural rubber or other synthetic rubbers, such as polybutadiene acrylonitrile rubbers or polybutadiene-styrene rubbers. All of such materials conveniently can contain carbon black to make them electrically conductive.

The inner and outer soles are connected together at a plurality of points to ensure good electrical contact. Therefore, if the thin outer sole wears at one place so that the hard-wearing central layer or layers is exposed, there is sufficient further outer layer of the thin flexible sole still in electrical contact with the inner sole.

The contact between the inner layer of the sole and the outer layer of the sole can be through a plurality of plugs. The plugs act as spacers in holding the two layers apart when one or more inner layers of hard-wearing material are moulded between the inner sole and the outer sole. The plugs can be of the same material as the flexible outer sole. The plugs do not have to be flexible and so can contain a high percentage of carbon black. Thus, the plugs may also be made of polyvinylchloride, a thermoplastics rubber, a polyurethane, or a polybutadiene acrylonitrile rubber, all of which contain carbon black.

The complete sole can be made by positioning the inner and outer soles in a mould with the plugs between them and then injection-moulding the hard-wearing material into the mould. The hard-wearing material may be any suitable hard-wearing material, such as a suitable plasticised polyvinyl chloride.

The outer sole may be manufactured by calendering a sheet, compression-moulding or injection-moulding. The outer sole may be treated to make it oil, fat and/or grease resistant. This can be done by adjusting the formulation of the outer sole to incorporate materials resistant to oil. The outer sole can also be made heat-resistant, again by incorporating a heat-resistant material in the flexible outer sole.

The footwear provided by the invention is conductive due to the low electrical resistance between the inner and the outer part of the footwear and, generally also is anti-static, i.e. it prevents static electricity building up in the footwear when it is worn. The footwear may be any suitable article of footwear, for example a boot, shoe, or the like.

The invention is illustrated by reference to the accompanying drawings in which

Figure 2:
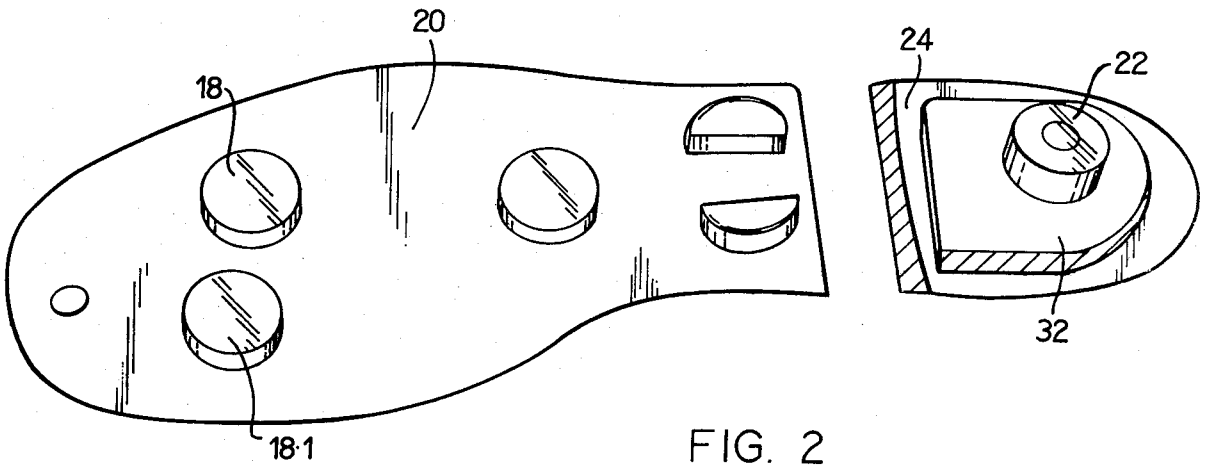

FIG. 1 is a cross-section through a shoe having a composite sole in accordance with the invention; and FIG. 2 is a three-dimensional top view of a flexible outer sole and heel base for use according to the invention.

In FIG. 1, a shoe shown generally at 10 comprises a shoe upper 12 attached to a composite sole according to the invention as shown generally at 14.

By way of exemplification the composite sole may comprise an inner sole of conducting fiberboard 16 heat-fused through plugs 18, 18.1 of electrically conductive polyvinylchloride to an outer sole 20 of electrically conducting polyvinylchloride. The outer sole 20 may be about 2 mm thick and cut from a flexible sheet.

The inner sole 16 is also connected through a plug 22 of electrically conductive polyvinylchloride to underneath portion 24 of heel 26. The heel further includes, for example a wooden block 28. Moulded between the inner sole 16 and the outer sole 20 is a layer 30 of a suitable plasticised polyvinyl chloride.

In FIG. 2, the outer sole 20 and underneath heel 24 are of thin flexible electrically conducting polyvinylchloride about 2 mm thick. Plugs 18, 18.1, 18.2, etc. are electrically conducting and are moulded integrally with the sole 20. A plug 22 is integral with the underneath of the heel and is of electrically conducting material. A pre-moulded filling is shown at 32. To make a composite sole, the parts 20 and 24 are placed in a mould, an electrically conducting inner sole is positioned in electrical contact with the top of the plugs 18, 18.1, 18.2, etc. and a layer of plastics material is then moulded between the inner and outer soles.

Both the plugs and the flexible outer sole are of polyvinylchloride (BSS 35 to 50) with preferably a minimum of 25 parts of carbon black per 100 parts of total composition for electrical conduction. Suitably lower proportions (eg 18 to 24% by weight) may be used if an antistatic composition only is required.

As illustrated in FIG. 2, the sole may be made as a composite unit comprising the thin outer sole and the plugs in the form of studs. Thus the outer sole may be clicked out from a conducting PVC sheet. Conducting plugs can be made from the same composition and glued onto the sheet with conducting PU cement at specific points. Alternatively, the composite may be moulded as one unit. It is also possible to carry out a two-stage injection where normal plasticised PVC or a blend is injected onto the upper sole leaving the outer sole and plugs for a second-stage moulding as a composite. This two-stage method produces a well made conducting article which is fully conducting as the plugs are in direct contact with the conducting inner sole. Microcellular conducting composites can also be used for this purpose.

Other polymers such as thermoplastic rubber, natural rubber or synthetic rubbers and compatible blends of these can also be used providing they are mixed with the appropriate content of conducting carbon black as shown in the table of typical conducting formulations. Typical formulations are as follows:

| FORMULATIONS | F | G | H |
|---|---|---|---|
| TPR Soling Compound | 100 | — | — |
| Rubber composition (prior to vulcanisation) | — | 100 | — |
| Injection Moulding rubber composition (for use in hot moulds) | — | — | 100 |
| Lubricant soap | 0,5–1 | 0,5–1 | 0,5–1 |
| Vulcan XC-72 | 65–75 | 65–75 | 65–75 |
| Antioxidant | — | 1–3 | 1–3 |

The mixing can be carried out in an internal mixer followed by sheeting off on a mill.

The process can be applied to the injection moulding process for rubbers using hot moulds (i.e. the DMS Process). It can equally be applied to the normal technique of producing unit soles or direct vulcanisation of rubber onto leather uppers.

The following non-limiting Examples illustrate the invention.

EXAMPLE 1

The actual composition of the plugs and flexible outer sole, in one embodiment, was as follows:

| | |
|---|---|
| 'Corvic' Polymer Resin (K value 70) | 100 parts by weight |
| + D.I.O.P. | 70 parts by weight |
| Epoxidised Soya Bean Oil | 40 parts by weight |
| ++ Nitrile Rubber | 10 parts by weight |
| Calcium Stearate | 1 parts by weight |
| Stearic Acid | 0,5 parts by weight |
| Ba/Cd stabiliser | 5 parts by weight |
| Vulcan XC-72 | 70–75 parts by weight |

+ Other plasticisers such as BBP and DIOA can also be used.
++ Ter-polymers of EVA such as Elvaloy 741 or 742 can also be used.

Other formulations which have been tried and proved effective, are as set out in Table 1.

TABLE 1

TYPICAL CONDUCTING FORMULATIONS

| Formulation | A | B | C | D | E |
|---|---|---|---|---|---|
| 'Corvic' 6611 | 100 | 100 | 100 | 100 | 100 |
| DIOP | 96 | 40 | 115 | 60 | 70 |
| BBP | — | | 20 | 40 | 20 |
| Epoxidised Soya Bean Oil | 5 | 40 | 5 | 5 | 5 |
| Nitrile Rubber | — | 10 | — | — | — |
| Calcium Stearate | 1 | 1 | 1 | 1 | 1 |
| Stearic Acid | 0,5 | 0,5 | 0,5 | 0,5 | 0,5 |
| Ba/Cd Stabiliser | 5 | 5 | 5 | 5 | 5 |
| Vulcan XC-72 | 72 | 75 | 75 | 72 | 70 |

In the above table, the amounts given are amounts by weight of 100 parts by weight of polymer. Instead of using the polymer 'Corvic' S 6611, further alternatives are S 7106 K-65 and E 7262. When making conducting materials from these compositions, the compositions were blended in a Banbury mill and milled on a twin roll mill to ensure that the carbon black was dispersed thoroughly throughout the plastics composition and thereby to ensure good conductivity. The soles were 3 mm thick. The footwear in these examples and provided by the invention meets the South African Bureau of Standards requirements for electrically conductive safety footwear.

EXAMPLE 2

A conductive PVC preform was made up to the pattern in FIG. 2 using compression moulded sheets cut to the shape of the studs and the sole. The studs were bonded to the 3 mm thick sole using conductive polyurethane cement. The conductive PVC was formulated as in Example 1 and coded 'Welvic' N3/J340. This material is available from AECI Limited.

This preform was placed in the mould cavity of a shoe moulding machine in contact with the conductive inner sole of a lasted upper leather boot. Flexible PVC compound coded 'Welvic' I9/J130 was injected into the mould to form the finished conductive boot.

Caparative tests were carried out with boots having conventional conducting rubber soles.

The tests were carried out by contacting the inner and outer soles with brass electrodes under dry conditions and standard pressure using the electrodes mounted on spring-loaded tongs connected to a standard megohmmeter operating at 500 volts.

The results are set out in Table 2 for four pairs of boots A, B, C, D. Individual left and right boots are subcoded 1, 2 as shown.

TABLE 2

| BOOT CODING | A1 | A2 | B1 | B2 | C1 | C2 | D1 | D2 |
|---|---|---|---|---|---|---|---|---|
| Soling material | R | R | R | R | PVC | PVC | PVC | PVC |
| Reading after one week (ohm $10^6$) | 0,04 | 0,04 | 0,06 | 0,04 | 0,02 | 0,02 | 0,03 | 0,02 |
| Reading after 2 weeks (ohm $10^6$) | 0,07 | 0,05 | 0,08 | 0,05 | 0,02 | 0,02 | 0,04 | 0,02 |
| Reading after one month (ohm $10^6$) | 5 | 7 | 9 | 8 | 0,04 | 0,04 | 0,05 | 0,04 |
| Reading after 2 months (ohm $10^6$) | 50 | 30 | 35 | 60 | 0,09 | 0,08 | 0,10 | 0,12 |
| Reading after 3 months (ohm $10^6$) | 75 | 50 | 90 | 85 | 0,15 | 0,13 | 0,16 | 0,15 |
| Reading after 14 weeks (ohm $10^6$) | >200 | >200 | >200 | >200 | 15 | 22 | 17 | 19 |

In this Table, R is a vulcanised conductive rubber boot of conventional construction and PVC is the "Welvic" N3/J340 referred to above.

These results demonstrate the superiority of the boot made according to the invention which remained conductive (resistance not more than $0.15\times10^6$ ohm) for about 3 months and anti-static (resistance not more than $50\times10^6$ ohm) thereafter.

By contrast the conventional conductive rubber boots became non-conductive in less than 1 month and even failed the anti-static requirements after 2 to 3 months.

EXAMPLE 3

This illustrates that a commercially available 'TPR' (thermoplastic rubber) soling compound may replace PVC in this invention to make an outer sole about 3 mm thick.

'TPR' soling compound was first moulded on to leather uppers leaving several round holes in the sole for the conductive plugs.

The conductive TPR formulation F was then injected into the same mould with the sole plate dropped by 2 mm to allow the moulding to be completed according to the invention.

The complete structure had excellent conductive properties.

EXAMPLE 4

This illustrates the use of vulcanised conductive rubber in combination with non-conductive PVC.

A vulcanised rubber containing a high loading of carbon black as in formulation G was preformed into a 3 mm thick outer sole and connecting studs as in FIG. 2.

This preform was coated with conductive polyurethane cement and placed in contact with the conductive inner sole of a leather upper boot. Flexible PVC/nitrile blend ('Welvic' I9/J130) was then injected into the mould cavity. The composite boot was conductive and had good wearing properties.

I claim:

1. A composite sole for use in safety footwear, said composite sole comprising an inner sole of electrically conducting material, a thin flexible outer sole up to 8 mm thick of electrically conducting material, said outer sole being spaced from the inner sole and connected thereto at a multiple plurality of positions spaced apart over the area of the sole in an electrically conducting manner and a layer resistant to flex cracking between the inner and outer soles.

2. A composition as claimed in claim 1, wherein the outer sole is from 2 to 5 mm thick.

3. A composite sole as claimed in claim 1, wherein the inner and outer soles are connected together by a multiple plurality of electrically conducting spacer plugs.

4. A combination heel and sole for footwear, said combination comprising an inner sole of electrically conducting material, a thin flexible outer sole up to 8 mm thick of electrically conducting material, said outer sole being attached to the underside of a heel, said inner and outer soles being held apart by and connected in electrically conducting manner by a multiple plurality of electrically conducting plugs spaced apart over the area of the sole and filler material around the plugs and between the inner and outer soles.

5. A combination as claimed in claim 4, wherein the outer sole is from 2 to 5 mm thick.

6. A combination as claimed in claim 4, wherein spacer plugs also form electrical connections between the underside of the heel and a rearward extension of the inner sole.

7. An article of footwear comprising an upper and a combination heel and sole, said combination comprising an inner sole of electrically conducting material, a thin flexible outer sole up to 8 mm thick of electrically conducting material, said outer sole being attached to the underside of a heel, said inner and outer soles being held apart by and connected in electrically conducting manner by a multiple plurality of electrically conductive plugs spaced apart over the area of the sole, a layer of filler material which is resistant to flex-cracking around the plugs and between the inner and outer soles, and at least one spacer plug also forming an electrical connection between the underside of the heel and a rearward extension of the inner sole.

8. An article of footwear as claimed in claim 7, wherein the outer sole is from 2 to 5 mm thick.

9. A method of making a combined sole and heel for footwear, which comprises positioning an inner sole of electrically conducting material in a mould, spacing a thin flexible outer sole of electrically conducting material up to 8 mm thick from the inner sole and separated therefrom by a multiple plurality of electrically conducting plugs spaced apart over the area of the sole, and injecting hard-wearing flex-resistant material into the mould between the inner and outer soles and around the plugs while maintaining the plugs in electrically conducting contact with the inner and outer soles.

10. A method as claimed in claim 7, wherein the outer sole is from 2 to 5 mm thick.

* * * * *